US011338987B2

(12) United States Patent
Newell

(10) Patent No.: US 11,338,987 B2
(45) Date of Patent: May 24, 2022

(54) FLUID VESSEL WITH CONFIGURABLE SHAPE

(71) Applicant: THE SECRETARY OF STATE FOR DEFENCE, Salisbury (GB)

(72) Inventor: David Timothy Newell, Salisbury (GB)

(73) Assignee: The Secretary of State for Defence, Salisbury (GB)

( * ) Notice: Subject to any disclaimer, the term of this patent is extended or adjusted under 35 U.S.C. 154(b) by 0 days.

(21) Appl. No.: 16/971,561

(22) PCT Filed: Mar. 6, 2019

(86) PCT No.: PCT/GB2019/000042

§ 371 (c)(1),
(2) Date: Aug. 20, 2020

(87) PCT Pub. No.: WO2019/175526

PCT Pub. Date: Sep. 19, 2019

(65) Prior Publication Data

US 2020/0399049 A1 Dec. 24, 2020

(30) Foreign Application Priority Data

Mar. 15, 2018 (GB) ..... 1804152

(51) Int. Cl.
*B65D 57/00* (2006.01)
*B65D 83/00* (2006.01)
(Continued)

(52) U.S. Cl.
CPC ..... *B65D 83/0055* (2013.01); *B65D 57/00* (2013.01); *F41B 9/0046* (2013.01);
(Continued)

(58) Field of Classification Search
CPC ..... B65D 83/0055; B65D 57/00; B65D 2231/001; B65D 1/32; F41B 9/0046; F41B 9/0078; F42B 33/062
See application file for complete search history.

(56) References Cited

U.S. PATENT DOCUMENTS 3,382,800 A * 5/1968 Biggs, Jr. ..... F42B 12/50 102/369
4,264,018 A * 4/1981 Warren ..... F02K 9/605 220/723

(Continued)

FOREIGN PATENT DOCUMENTS

CN 201427706 Y 3/2010
WO 0003893 A1 1/2000
WO 2005123523 A2 12/2005

OTHER PUBLICATIONS

United Kingdom Patent Application No. GB1903404.0, Notice of Intention to Grant dated Sep. 2, 2020, 2 pages.

(Continued)

*Primary Examiner* — Frederick C Nicolas
(74) *Attorney, Agent, or Firm* — Kilpatrick Townsend & Stockton LLP

(57) ABSTRACT

A configurable fluid vessel including a flexible bladder having a fluid port through which a fluid such as water can be provided into the bladder. The fluid vessel includes an internal support frame within the flexible bladder to increase rigidity and can be manipulated into a predetermined shape. The fluid vessel is collapsible for storage whilst retaining rigidity when in use. The fluid vessel is particularly suited for use in explosive jet disruptors for tailoring the formation of a fluid jet.

18 Claims, 6 Drawing Sheets

(51) Int. Cl.
*F41B 9/00* (2006.01)
*F42B 33/06* (2006.01)
*B65D 1/32* (2006.01)

(52) U.S. Cl.
CPC ..... *F41B 9/0078* (2013.01); *B65D 1/32* (2013.01); *B65D 2231/001* (2013.01); *F42B 33/062* (2013.01)

(56) References Cited

U.S. PATENT DOCUMENTS 5,000,354 A * 3/1991 Lee ..... B65D 1/32 222/213
5,615,791 A * 4/1997 Vatelot ..... B65D 1/0292 215/382
6,068,152 A * 5/2000 Meiners ..... B65D 77/06 220/1.6
6,269,725 B1 * 8/2001 Cherry ..... F42B 1/02 102/306
6,584,908 B2 * 7/2003 Alford ..... F41B 9/0046 102/302
7,313,994 B1 1/2008 Lacombe et al.
8,267,013 B2 * 9/2012 Moore ..... F42B 3/087 102/331
8,677,902 B1 * 3/2014 Rock ..... F41B 9/0046 102/306
9,429,408 B1 8/2016 Chamberlain et al.
9,909,834 B1 * 3/2018 Wilhelm ..... F42B 3/00
2004/0112241 A1 * 6/2004 Alford ..... F42B 3/08 102/364
2013/0112688 A1 * 5/2013 Krikor ..... A23L 2/42 220/212
2014/0158688 A1 * 6/2014 Loughrin ..... B65D 41/185 220/304
2014/0226921 A1 * 8/2014 Albers ..... B65D 33/25 383/86.2

OTHER PUBLICATIONS

United Kingdom Patent Application No. GB1903404.0, Decision to Grant dated Oct. 20, 2020, 2 pages.
International Patent Application No. PCT/GB2019/000042, International Preliminary Reporton Patentability dated Sep. 24, 2020, 7 pages.
United Kingdom Patent Application No. GB1804152.5, Search Report dated Sep. 6, 2018, 4 pages.
International Patent Application No. PCT/GB2019/000042, International Search Report and Written Opinion dated Jun. 4, 2019, 10 pages.
United Kingdom Patent Application No. GB1903404.0, Combined Search and Examination Report dated Aug. 23, 2019, 6 pages.

* cited by examiner

FLUID VESSEL WITH CONFIGURABLE SHAPE

TECHNICAL FIELD OF THE INVENTION

This invention relates to the field of fluid vessels, in particular to fluid vessels with user configurable shape.

BACKGROUND TO THE INVENTION

Fluid vessels generally refer to hollow containers used to hold liquids or other fluids (substances that can flow). Fluid vessels are used in a broad range of civilian and military applications including, but not limited to, fuel and water storage/transport. In applications where a fluid vessel is to be used as a permanent structure, the vessel is often provided in a fixed form i.e. a container moulded from a relatively high strength material, the container having fixed dimensions and shape. An example of such a permanent structure is a fuel tank in a car. However, in applications where a fluid vessel is to be used semi-permanently, or infrequently, then a large fixed structure can be undesirable. An example of such a situation is a large water storage container at a temporary refugee camp. This is particularly the case where the fluid vessel is to be regularly transported or placed in storage between uses. In these circumstances, configurable fluid vessels are a well suited alternative.

Configurable fluid vessels themselves have a structure or shape that can be modified immediately prior to use, or indeed at the time of, use. An example of a configurable fluid vessel is a stowable water container for use when camping, hiking or in other outdoor pursuits. In the quest to achieve packable/stowable fluid vessels, the structural rigidity of the vessel itself has been compromised. For instance a stowable water container may collapse upon itself when being poured, or once the container has been partially emptied (for instance in a backpack based bladder system), because the container is dependent upon being filled with water to maintain its overall shape.

Another application of fluid vessels is their use in explosively driven water jet disruptors. An explosively driven water jet disruptor generally comprises an explosive and a consumable container filled with water. The explosive is configured such that when initiated, an explosive shock wave is formed that compresses and accelerates the water to form a high velocity plume/jet. Whilst these plumes or jets of water can be used to penetrate materials, they are also well suited to the disruption of improvised explosive devices. Current water jet disruptors comprise containers that are permanent structures with pre-defined size and shape, thereby delivering a reliable and repeatable plume/jet effect. An example of such a disruptor is provided by Rock et al in U.S. Pat. No. 8,677,902B1. Unfortunately these containers are relatively bulky and place additional burden on the user transporting the disruptor, or where space constraints are present, a limitation in the number of disruptors that can be carried/transported simultaneously. However this conflicts with the requirement of the user to carry a variety of fixed shape containers, in scenarios where he does not know the intended use of a jet disruptor.

Therefore it is an aim of the invention to provide an alternative fluid vessel with user configurable shape.

SUMMARY OF THE INVENTION

According to a first aspect of the invention there is provided a configurable fluid vessel comprising a flexible bladder having a fluid port, wherein the fluid vessel further comprises an internal support frame positioned within the flexible bladder.

A configurable fluid vessel is a container suitable for holding fluids, whose shape is configurable by a user. In particular a configurable fluid vessel is one which, when not in use, can be packed down/collapsed to minimise its volume, either for storage or transport. The shape of the fluid vessel may be modified by filling the vessel with a fluid, or by manipulating the vessel directly. A fluid itself is a substance that can flow and generally refers to a liquid, in particular water. However a fluid may also be used to refer to a gas, or a liquid suspended within which are solid objects or particulates. The configurable fluid vessel must 'contain' such a fluid i.e. where the fluid is water the configurable fluid vessel is regarded as water tight.

The configurable fluid vessel of the invention comprises a flexible bladder having a fluid port. The flexible bladder is the container of the fluid for which the invention is intended to be used i.e. the flexible bladder is impermeable to the fluid being contained. The use of a flexible bladder is advantageous because when the fluid vessel is not in use, the bladder is collapsible and thus occupies relatively less space than fixed vessel structures. Furthermore the bladder can be relatively lightweight, and therefore less of a burden to transport. The bladder is flexible in that it can be manipulated to form a variety of shapes based on the amount of fluid contained and any objects pressing against/urging against the bladder surface. For instance the bladder may be placed inside a fixed structure such that when the bladder is filled with a fluid, it conforms to the internal surface of said structure. The fluid port of the bladder is an aperture in the bladder through which fluid may enter and leave the bladder. Preferably the fluid port comprises a valve to restrict or prevent fluid flowing into, out of, or into and out of, the bladder. A fluid port is necessary where fluid contained within the bladder is pressurised, and its exit through the fluid port is undesirable.

The internal support frame is positioned within the flexible bladder. The support frame provides a degree of rigidity to the flexible bladder in one or more, preferably two, dimensions, preferably providing a partially rigid structure in a planar geometry whilst also providing a structure onto which other items may be fixed and held within the bladder. Use of an internal support frame provides improved structural rigidity to the configurable fluid vessel when compared to the prior art. For instance providing an internal support frame to a stowable water carrier provides a firm base structure, ensuring the water carrier will not roll over or fall. Alternatively providing an internal support frame to a backpack based flexible water carrier would prevent sagging of a partially filled water carrier, thereby making emptying, refilling, and drinking therefrom, easier. The support frame is intended to be substantially planar such that the configurable fluid vessel can pack down into substantially a plane when not in use or during transport. The term 'internal' in the context of the support frame means substantially all of the support frame is fully enclosed within the flexible bladder. However, parts of the support frame may extend beyond the bladder providing that a fluid-tight seal is provided around any protruding parts. The support frame may comprise one or more elements that are hingedly attached to each other, so as to allow the frame and bladder to be folded when not in use, thereby reducing the spatial extent of the support frame further.

Preferably the configurable fluid vessel further comprises urging means arranged within the flexible bladder for urging the flexible bladder into a predetermined shape. The urging means may comprise at least one support strut. The support struts may be elongate members attached to the internal support frame. The support struts are intended to provide structural support to the flexible bladder in the plane of the support frame or at an angle to the plane of the support frame. The support struts therefore are intended to come into contact with, but not be permanently attached to, the flexible bladder. The support struts press on the internal surface of the flexible bladder, to urge the flexible bladder to define a particular internal and external shape. In preferred embodiments each support strut is adjustable from a collapsed position to at least one strut position. The support struts may be adjustable through extension i.e. they may be telescopic in nature. Alternatively the support struts may be rotatably attached to the support frame to allow their orientation to be adjusted. Alternatively the support struts may be both rotatable and extendible. The collapsed position therefore refers to the struts in their default position, which is either unextended, rotated to lie within the plane of the support frame, or both. The collapsed position is therefore essentially the 'packable' or 'stowable' configuration i.e. the position where the configurable fluid vessel is occupying least volume for storage or transport. The at least one strut position are predefined positions (for instance extensions, rotations, or both) other than the collapsed position. Manipulating a support strut to a strut position will urge the flexible bladder to define a particular internal shape in the vicinity of the respective strut. Having a plurality of struts, each providing localised urging of the flexible bladder, therefore allows the overall shape of the flexible bladder to be configurable. For instance a plurality of internal struts may be rotated from the plane of the support frame to strut positions perpendicular thereto, urging the flexible bladder to form a cuboid shape. For a flexible water carrier this would ensure the carrier wouldn't collapse when pouring water, instead the 'roof' of the bladder being supported by the support struts. Once used, the struts may be moved back to the collapsed position for storage. A further advantage of using internal support struts is that a fluid carrier or temporary fluid storage container having an internal support frame forming a rigid base, that punctures at a height above the base of the carrier/container, will not fully empty itself. This is because the support struts will maintain the three dimensional form of the bladder, thereby only resulting in partial emptying of the fluid vessel. This is not achievable in some prior art configurable fluid vessels that inevitably collapse as they empty.

To assist with maintaining the support struts in the desired extensions or orientations, preferred embodiments of the invention provide support struts that are lockable in a given position. When being extended, a locking mechanism may be used, similar to that used in writing pens, to lock and unlock a support strut at a desired extension. For rotational locking the support frame may be provided with a pin that urges onto a disk attached to a support strut, the disk having a series of holes at various rotational offsets into which the pin can move as the support strut and disk rotates, thereby fixing the rotation of the support strut. The pin and disk may be urged together by a spring mechanism, such that the user of the fluid vessel can overcome the spring tension to separate the pin from the disk when the strut orientation needs to be further adjusted.

Either as an alternative, or in addition to the locking of the support struts, the flexible bladder may itself comprise a plurality of strut interfaces. Each strut interface at least partially conforming to the section of a respective support strut that urges against the internal surface of the bladder. Such an interface provides a degree of resistance against the support strut moving away from the intended strut position, owing to the support strut essentially residing partially within the strut interface. Furthermore each strut interface may comprise a thicker section of bladder material for reinforcement purposes to protect against puncturing, or may comprise some other suitable reinforcement material.

The internal support frame and support struts may themselves be formed from a plastic or other lightweight material suitable for use in fluid environments i.e. would not become brittle or weak when submerged in a fluid such as water.

Preferred embodiments of the configurable fluid vessel have an urging means comprising an internal support band positioned within the flexible bladder. The internal support band is an elongate loop of material that urges against the inner surface of the flexible bladder, so as to maintain the bladder in a particular shape. One or more support bands may be provided within the flexible bladder. The urging means may further comprise at least a first toothed tongue fixed to the internal support frame, each toothed tongue being receivable into a respective click-lock aperture provided with the internal support band. A click-lock aperture is an aperture through the internal support band having a protrusion from the support band extending partially across the aperture. The protrusion itself may be integrally formed with the support band. The protrusion provides resistance against a respective toothed tongue passing through the click lock aperture, although this resistance may be overcome by a user. The toothed tongue itself is an elongate member extending from, and fixedly attached to, the internal support frame. A user of this embodiment of the configurable fluid vessel may overcome the resistance of the protrusion of the click lock aperture, and force the toothed tongue through the respective click lock aperture. The toothed tongue has grooves in its surface such that as the tongue is forced through the click lock aperture, the protrusion is received into successive grooves of the tongue. The protrusion remaining within each groove unless forced out of it by the user. The toothed tongue may thus be locked into a user selected position. Preferably the internal support band and toothed tongue are formed from a plastic material.

The flexible bladder may be formed from a stretchable material such as silicone. The material may fit tightly to the support frame (reducing spatial requirements when not in use) and stretch when filled or urged into position by the support struts. Alternatively the material may not stretch under normal fluid filling conditions, but may stretch when being filled under pressure, or when the bladder is urged into a position by the support struts or support band/s. Silicone in particular can be used to form a bladder that is relatively lightweight, stretchable and impermeable to a variety of fluids including water.

According to a second aspect of the invention there is provided an explosively driven jet disruptor system comprising the configurable fluid vessel of the first aspect of the invention, an explosive charge and a detonator, wherein the explosive charge is positioned internally to the flexible bladder, the detonator being positioned externally to the flexible bladder.

An explosively driven jet disruptor system may be used to penetrate or disrupt/damage a barrier or a device such as an improvised explosive device. In general such a disruptor system comprises a fixed shape fluid vessel filled with water, a small quantity of explosive charge and a detonator. The detonator initiates the explosive charge, which generates an explosive shock. The explosive shock acts upon the water within the consumable fluid vessel in a manner that compresses and accelerates the water to form a high velocity plume or 'jet'. The plume/jet then delivers the kinetic effect upon the barrier or device being targeted. A particular disadvantage of standard explosively driven jet disruptors is that the fixed size/shape of the fluid vessel means the disruptor system has a relatively high space requirement, making it either awkward to transport, and reducing the space available to transport other equipment, or both.

Whilst the explosively driven jet disruptor system according to the invention delivers a disruptor system that is relatively lightweight and occupies less space when not in use compared to prior art disruptors, a key advantage is the benefit of customising the end effect of the fluid 'jet', effectively providing many different disruptor configurations in a single disruptor system. For instance the amount of fluid in the flexible bladder can be varied if using a stretchable material; and/or the use of support struts/bands allows the overall shape of the bladder to be adjusted. Both allow a tailoring of the fluid 'jet' to each application i.e. a fast thin jet for penetrating thicker targets, or a slower wider jet for larger or thinner skinned targets.

The 'explosive charge' of the second aspect of the invention is the explosive material that once initiated, generates the explosive shock that acts on the fluid contained within the flexible bladder of the configurable fluid vessel. The explosive charge may be military explosives such as PE6, PE8 or C4; plastic explosives; or wax bonded explosives, for example. The explosive charge is internal to (fully contained within) the flexible bladder. This ensures a mass of fluid intimately surrounds the explosive charge. Configuring the shape of the flexible bladder varies the amount of fluid on opposite sides of the explosive. This configurability allows the directionality of the water jet generated by the disruptor upon detonation of the explosive, to be varied. For instance a relatively large mass of liquid on one side of the explosive in comparison to the opposite side of the explosive, provides a tamp effect, achieving directionality of the liquid jet in the direction of the lower liquid mass. By providing a liquid mass surrounding the explosive charge, this tamp effect can be utilised.

The 'detonator' is the device that initiates the explosive charge. The detonator may be an electric detonator (for instance of the low voltage type); pyrotechnic flash detonator; shock tube detonator. The detonator is preferably positioned externally to the flexible bladder of the configurable fluid vessel, with the detonation 'shock' being sufficient to propagate through the bladder and detonate the explosive contained therein.

The detonator may be detached from the configurable fluid vessel, but in preferred embodiments of the second aspect of the invention the explosive charge and detonator are held by the internal support frame. In these embodiments 'held' means attached to and fixed in position. For example the support frame may extend through the flexible bladder so as to provide a point of support to the detonator, for instance a mount into which the detonator is screwed, glued or interference fitted. The flexible bladder being sealed in a fluid-tight manner around the support frame in the region where the support frame extends through the bladder. Such a seal may be formed by a clamp or adhesive. The explosive charge is attached to the support frame inside the bladder, such that is it surrounded by fluid when the bladder is filled.

The explosive may be elongate in the plane of the internal support frame, such that when not in use the explosive does not increase the spatial extent of the configurable fluid vessel. In preferred embodiments of the invention the explosive charge comprises at least a first sheathed detonating cord. The sheath preferably is metal (aluminium or silver) but plastic sheathing can also be used. Sheathed detonating cord is advantageous as very high explosive packing density can be achieved within a very thin sheath thickness. This means less physical space is required for this form of explosive. The advantage of using metallic sheathing is that the ends of the cord can be sealed to prevent water ingress, which is crucial for certain explosives where water ingress may stop the explosive from functioning, and metal sheathed cord delivers predictability owing to the uniformity in which metal can be 'drawn-out' during manufacture. The sheathed explosive cord may extend between two parallel sections of the support frame. One or more explosive cords may be used, depending on the desired effect of the explosively driven jet disruptor system.

BRIEF DESCRIPTION OF THE DRAWINGS

Embodiments of the invention will now be described by way of example only and with reference to the accompanying drawings, in which.

DETAILED DESCRIPTION

Figure 1A:
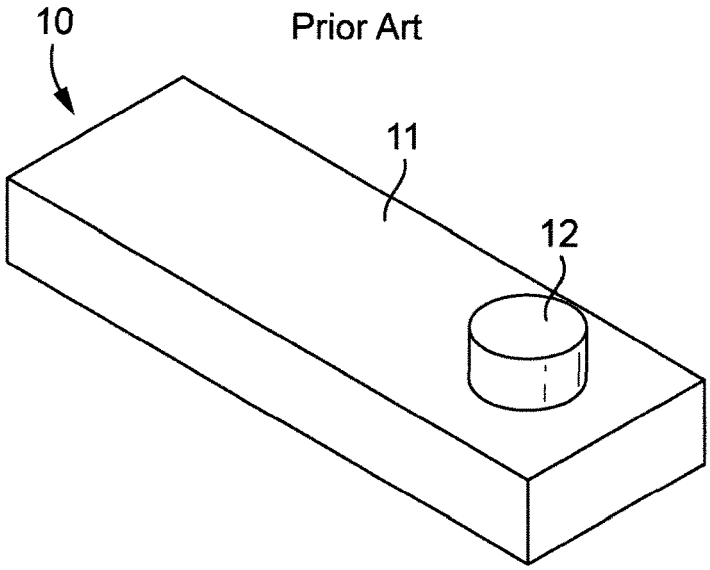
Fig. 1a Prior Art
FIG. 1*a* shows an illustration of a prior art configurable fluid vessel prior to filling.
Figure 1B:
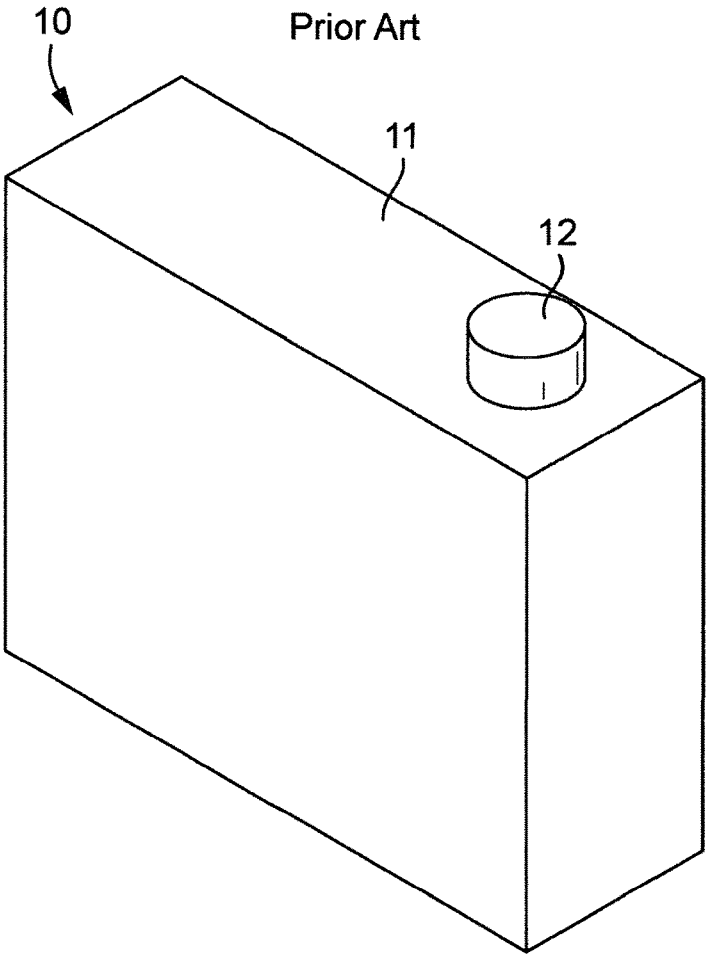
Fig. 1b Prior Art
FIG. 1*b* shows an illustration of a prior art configurable fluid vessel after filling.

FIG. 1*a* shows an illustration of a prior art configurable fluid vessel 10 prior to filling. The vessel comprises a flexible bladder 11 having a fluid port 12. The fluid vessel 10 is shown collapsed because there is no support structure or fluid to support the bladder 10. FIG. 1*b* shows the same prior art fluid vessel 10 filled with a fluid, for instance water.

Figure 2:
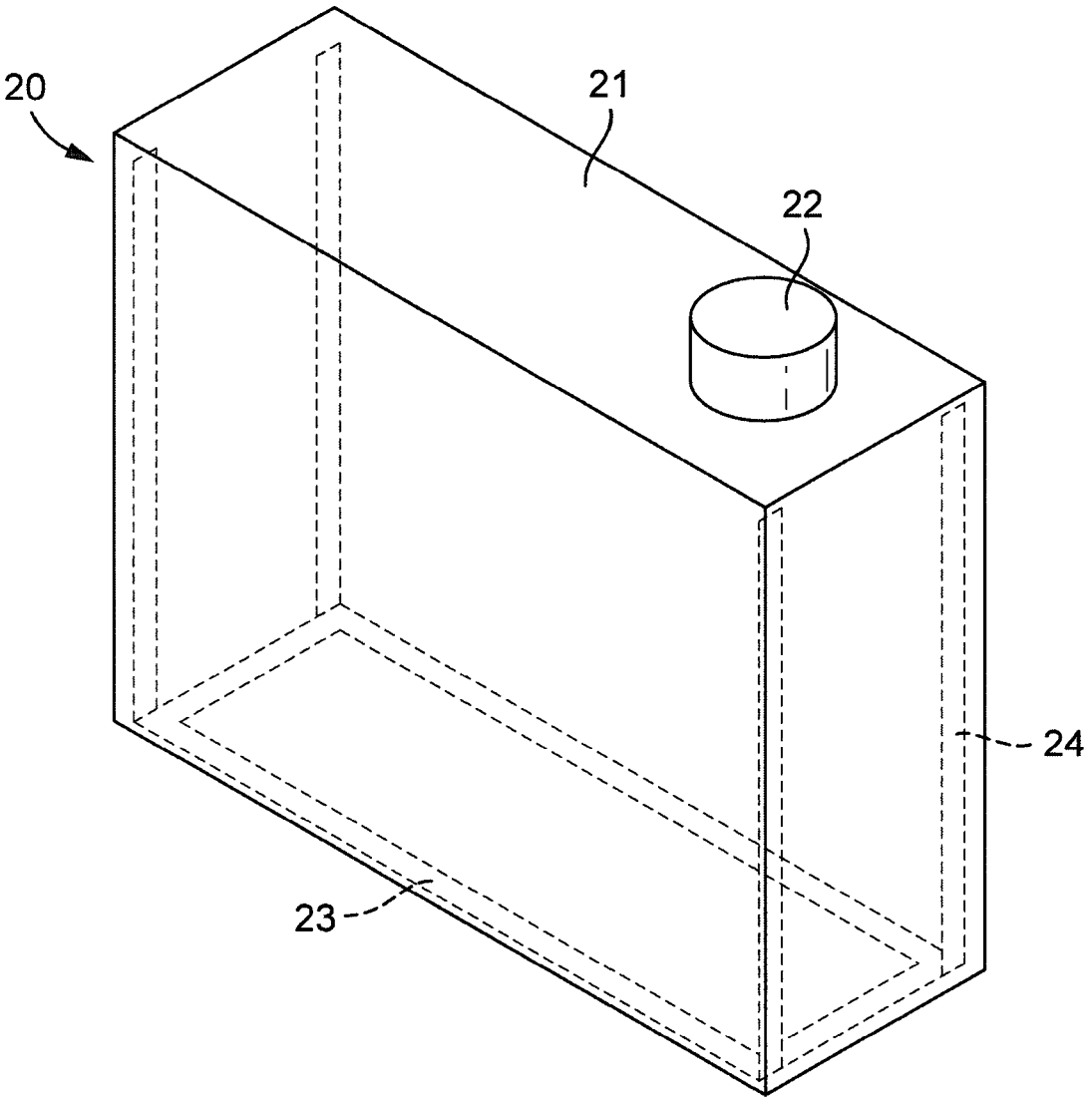
FIG. 2 shows an illustration of an embodiment of the configurable fluid vessel of the invention.

FIG. 2 shows an illustration of an embodiment of the configurable fluid vessel of the invention 20 comprising a flexible bladder 21, fluid port 22, support frame 23, and support struts 24. The support frame 23 is positioned inside the flexible bladder 21 and provides a substantially planar rigid base. Support struts 24 extend from the support frame 23 in a perpendicular orientation to provide support to the sides and top of flexible bladder 21. In the configuration shown in the illustration the fluid vessel 20 does not contain any fluid, but does not collapse owing to the action of the support frame 23 and struts 24 urging the 'roof' of the flexible bladder 21 into the shape illustrated. The struts 24 may be rotated to lie parallel to support frame 23 when the fluid vessel 20 is not in use/for transport purposes.

Figure 3:
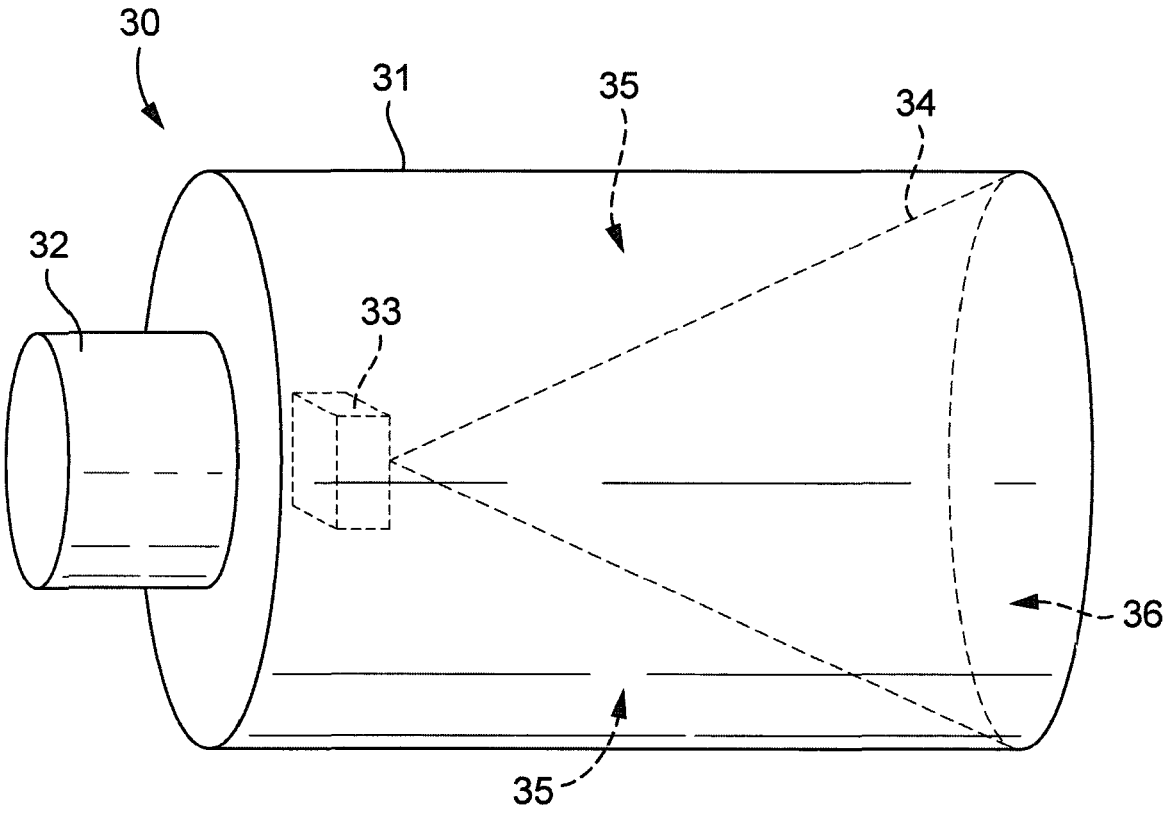
Fig. 3 Prior Art
FIG. 3 shows an illustration of a prior art explosively driven jet disruptor system.

FIG. 3 shows an illustration of a prior art explosively driven water jet disruptor 30. The disruptor 30 comprises a firm bladder or container 31 containing thin walls 34, defining water filled regions 35 and a conical cavity 36. Detonator 32 initiates explosive 33 within bladder 31, thereby generating an explosive shock that compresses and accelerates the water in water filled regions 35, resulting in thin walls 34 collapsing and the water forming a plume/jet propagating axially to the bladder 31. The disruptor 30 is disposable i.e can be used once in a single configuration defined by the fixed shape of firm bladder 31 and thin walls 34. Furthermore the fixed shape of firm bladder 31 is shown as contributing significantly to the overall size and shape of disruptor 30, making the disruptor awkward and bulky to transport.

Figure 4A:
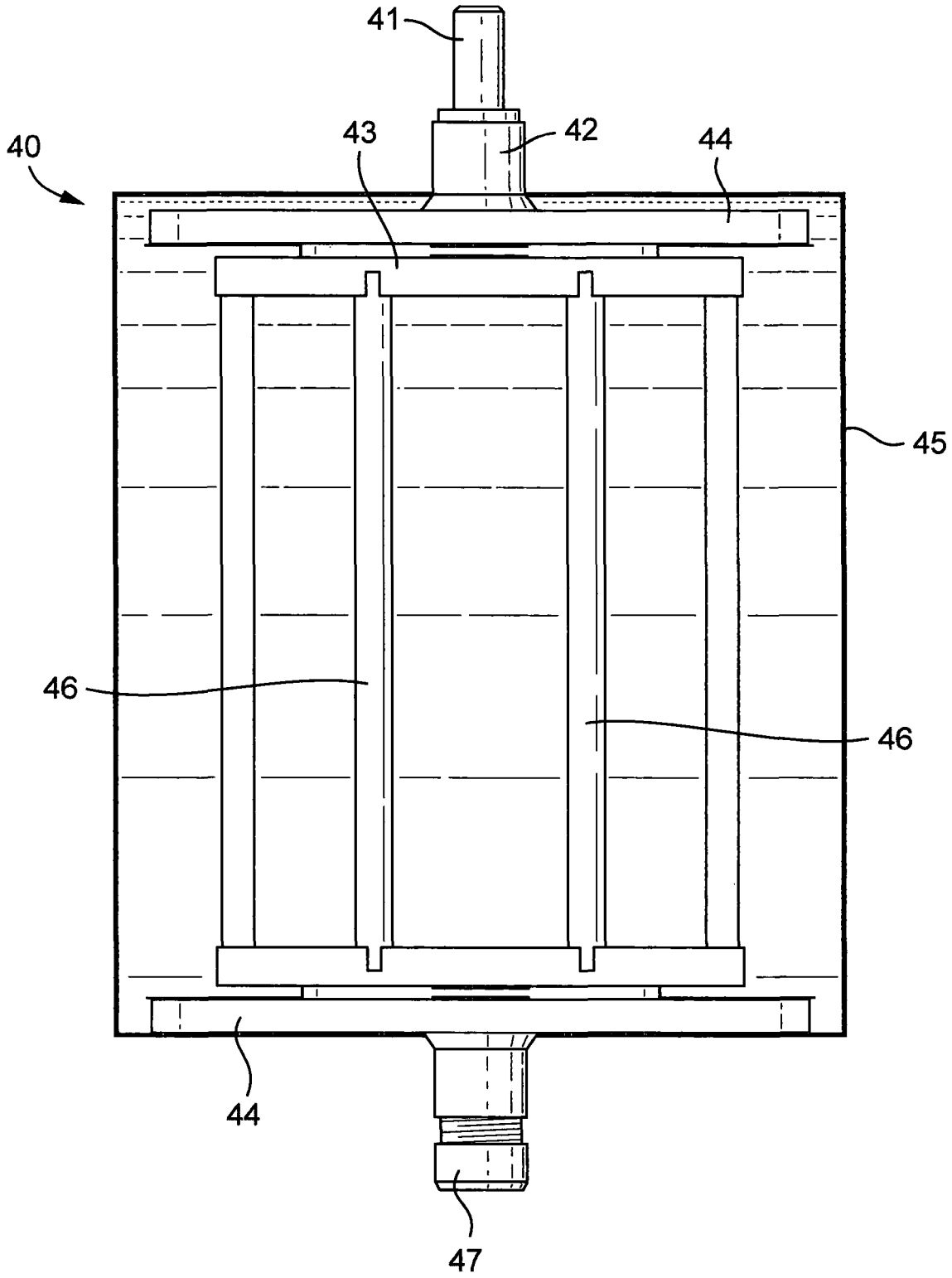
FIG. 4*a* shows a top view illustration of an embodiment of the explosively driven jet disruptor system of the invention comprising support bands and respective toothed tongues.
Figure 4B:
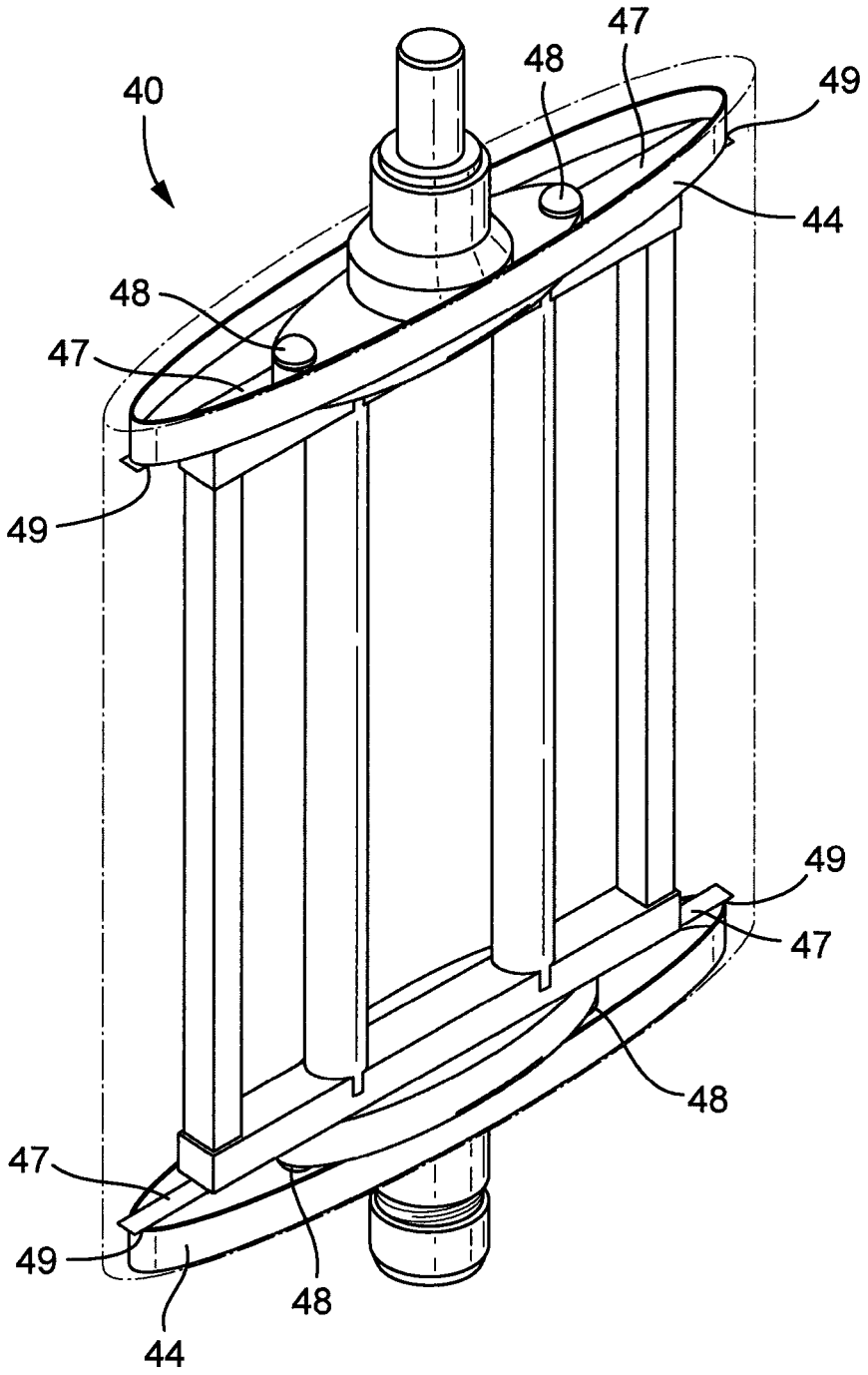
FIG. 4*b* shows a perspective view illustration of an embodiment of the explosively driven jet disruptor system comprising support bands and respective toothed tongues.

FIG. 4*a* shows a top view illustration of an embodiment of the explosively driven jet disruptor system of the invention 40 comprising support bands 44 and respective toothed tongues (hidden in the figure). The disruptor system 40 comprises a flexible bladder 45 and an internal support frame 43 within the bladder 45. The internal support frame 43 extends through bladder 45 to provide an interface 42 for a detonator 41. Also shown is fluid port 47. The explosive charge 46 comprises two metal sheathed detonating cords held in position by the support frame 43. The explosive charge 46 is surrounded by fluid, in this case water, contained within the flexible bladder 45. FIG. 4*b* shows the same disruptor system 40 of FIG. 4*b*, but in a perspective view. Shown in the figure are toothed tongues 47 attached to the support frame 43 at positions 48, and received into respective click lock apertures 49 in the support bands 44.

Figure 5A:
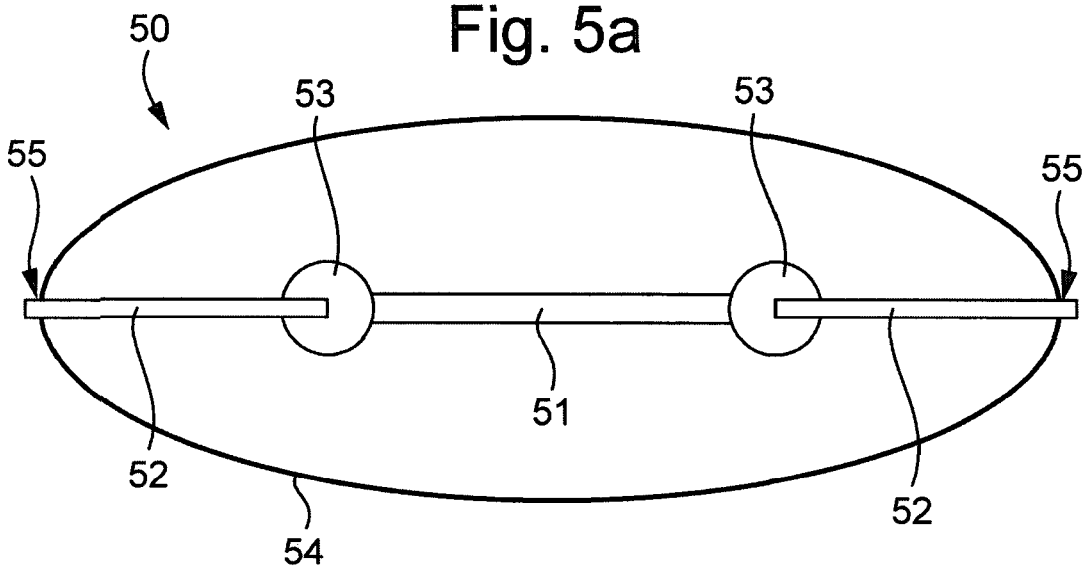
FIG. 5*a* shows an illustration of a support band and toothed tongue configuration in accordance with some embodiments of the invention.
Figure 5B:
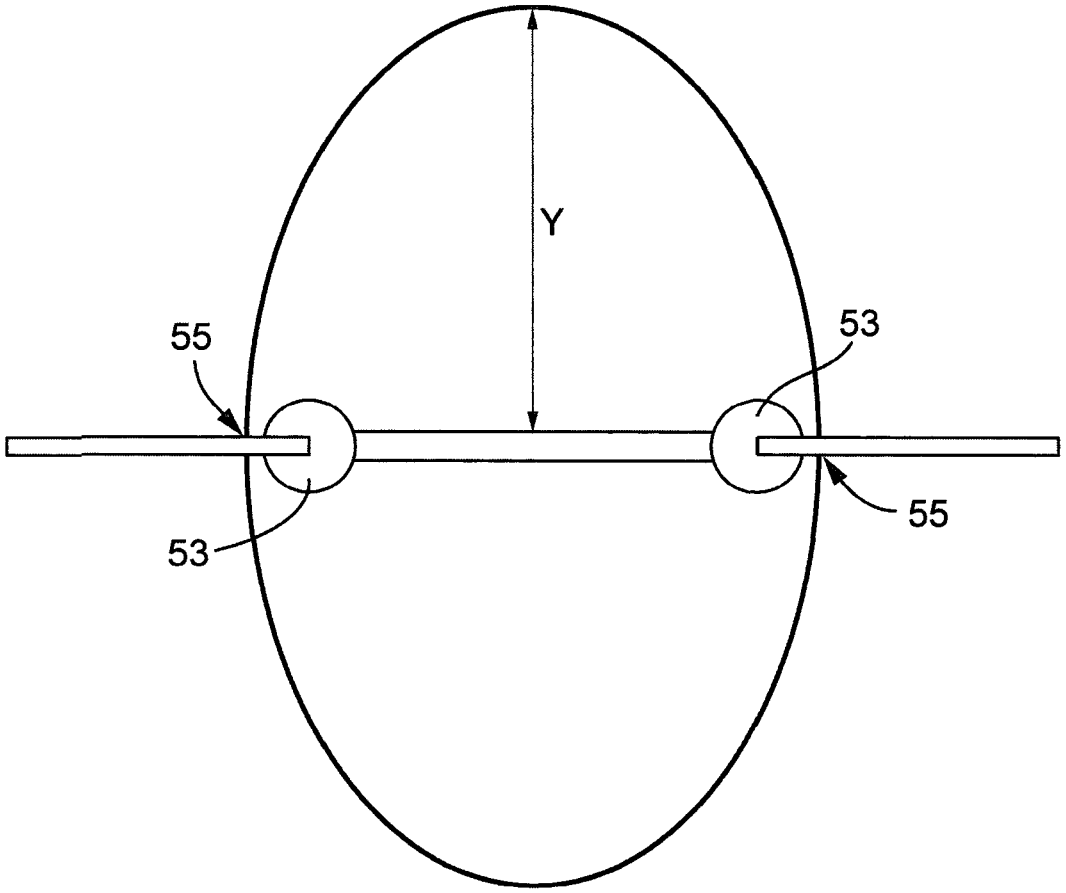
FIG. 5*b* shows an illustration of the toothed tongues of FIG. 5*a* being used to change the shape of the support band.

FIG. 5*a* shows an illustration of the support band and toothed tongue mechanism 50 used in some embodiments of the configurable fluid vessel, such as that shown in FIG. 4*a* and FIG. 4*b*. Toothed tongues 52 are attached to internal support frame 51 at positions 53. Toothed tongues 52 are received into click lock apertures 55 in support band 54. As support band 54 is forced along toothed tongues 52, the distance between positions 53 and click lock apertures 55 decreases, forcing distance 'Y' to increase as shown in FIG. 5*b*. The overall shape of the support band 54 in FIG. 5*b* has been changed, and therefore the shape of a flexible bladder (not shown) against which support band 54 abuts, would also change. Further toothed tongues 52 and respective click lock apertures 55 may be included in other embodiments of the invention, to provide further configurability over the shape of the support band 54 (and therefore any flexible bladder). For instance a toothed tongue and respective click lock aperture perpendicular to those shown in FIGS. 5*a* and 5*b* could be used.

The invention claimed is:

1. An explosively driven jet disruptor system comprising an explosive charge, a detonator and a configurable fluid vessel, wherein the configurable fluid vessel comprises a flexible bladder having a fluid port, and the explosive charge is positioned internally to the flexible bladder; and wherein the disrupter system further comprises an internal support frame positioned within the flexible bladder.

2. The explosively driven jet disruptor system of claim 1, wherein the internal support frame is planar.

3. The explosively driven jet disruptor system of claim 1, further comprising an urging means arranged within the flexible bladder for urging the flexible bladder into a predetermined shape.

4. The explosively driven jet disruptor system of claim 3, wherein the urging means comprises at least one support strut attached to the internal support frame.

5. The explosively driven jet disruptor system of claim 4, wherein the at least one support strut is adjustable from a collapsed position to at least one strut position.

6. The explosively driven jet disruptor system of claim 5, wherein the at least one support strut is lockable at the collapsed position and at the at least one strut position.

7. The explosively driven jet disruptor system of claim 4, wherein the flexible bladder comprises a plurality of strut interfaces.

8. The explosively driven jet disruptor system of claim 4, wherein the at least one support strut is formed from a plastic material.

9. The explosively driven jet disruptor system of claim 3, wherein the urging means comprises an internal support band.

10. The explosively driven jet disruptor system of claim 9, wherein the urging means comprises at least a first toothed tongue fixed to the internal support frame, and wherein each toothed tongue is receivable into a respective click-lock aperture provided on the internal support band.

11. The explosively driven jet disruptor system of claim 10, wherein the internal support band and at least a first toothed tongue are formed from a plastic material.

12. The explosively driven jet disruptor system of claim 1, wherein the flexible bladder is formed from a stretchable material.

13. The explosively driven jet disruptor system of claim 12, wherein the stretchable material is silicone.

14. The explosively driven jet disruptor system of claim 1, wherein the internal support frame is formed from a plastic material.

15. The explosively driven jet disruptor system of claim 1, wherein the detonator is positioned externally to the flexible bladder.

16. The explosively driven jet disruptor system of claim 15, wherein the explosive charge and detonator are held by the internal support frame.

17. The explosively driven jet disruptor system of claim 15, wherein the explosive charge is at least a first sheathed detonating cord.

18. The explosively driven jet disruptor system of claim 17, wherein the at least a first sheathed detonating cord is metal sheathed detonating cord.

* * * * *